United States Patent [19]

Grenga et al.

[11] 4,291,738

[45] Sep. 29, 1981

[54] UNIVERSAL SUPPORT FOR VERTICAL BLINDS AND THE LIKE

[76] Inventors: John Grenga; Samuel Frydman, both of 30 Carter Dr., Framingham, Mass. 01701

[21] Appl. No.: 9,069

[22] Filed: Feb. 5, 1979

[51] Int. Cl.[3] ..... E06B 9/262; E06B 9/32

[52] U.S. Cl. ..... 160/176 R; 160/166 A; 160/172

[58] Field of Search ..... 160/166–178

[56] References Cited

U.S. PATENT DOCUMENTS 2,844,199 7/1958 Achler et al. ..... 160/173

3,106,240 10/1963 Weber ..... 160/166 A 3,298,425 1/1967 Cayton et al. ..... 160/176

4,006,769 2/1977 Woodle ..... 160/166 A

*Primary Examiner*—Rodney H. Bonck

*Attorney, Agent, or Firm*—William Nitkin

[57] ABSTRACT

Disclosed is a universal support structure for the suspension of vertical louver-type Venetian blinds, draperies and hanging elements such as room dividers and the like. The system of this invention incorporates a novel support track and carrier system for the suspension and oscillation of such louvers. The track is notable in the fact that it is substantially as wide as the width of the louvers being supported and that the louver carriers are contained within the track.

7 Claims, 5 Drawing Figures

UNIVERSAL SUPPORT FOR VERTICAL BLINDS AND THE LIKE

BACKGROUND OF THE INVENTION

1. Field of the Invention

The apparatus of this invention resides in the area of support structures for vertical Venetian blinds and more particularly relates to an improved track and system for support of such blinds or other hanging members such as draperies and the like.

2. History of the Prior Art

At present there are many systems on the market for support of vertical Venetian blinds of the type wherein the vanes or louvers oscillate from side to side to allow or prevent the entry of light into a room. Such vertical Venetian blinds can also be used as room or area dividers and usually have a plurality of louvers suspended in a fashion from a track in a manner so that they are oscillatable and transversely movable. The louvers may be gathered to one side or the other of the opening in which they are placed dependent upon the movement of the carrier elements upon which they are affixed at their tops. Such tracks in the past have taken the form of carrier elements suspended from a track member having gripping means to hold the louver and means such as having weights suspended therein at the base of each louver for preventing their non-controlled movement. In some systems of the prior art key holes are utilized with chain extending from one louver to another being affixed to each after passing through the larger aperture of the keyhole and then caught in a narrower segment thereof. The direction of the oscillation of the louvers is accomplished by movement of control members in the upper track that rotate the carrier elements that support the louver. In the present art these control members may be a series of rods extending through the upper track upon which gears are mounted and which by rotation of these rods through a series of worm gears carrier elements are rotated. Other simpler supports utilize control chains or cables which rotate the carrier element. It is notable in the prior art that vertical louver drapes have a very high cost and are very specialized as to function.

SUMMARY

It is an object of this invention to provide a simplified universal system for the support of vertical blind louvers, drapes and the like which is not only economical in construction but also can be purchased in individual parts for assembly at home. The system of this invention will eliminate the need for the purchase of specialized and expensive track systems as discussed in the prior art which many times must be custom manufactured to the dimensions of the user's space where the vertical blinds are to be installed.

It is a further object of this invention that after purchase of individual components and louvers, which may be supplied in roll form, the purchaser can cut and assemble the blind system of this invention himself without the need for professional installation.

It is a further object of this invention to provide a novel track member having both functional and artistic design elements incorporated therein. More particularly disclosed is a track having a width substantially the width of the louver. Further the track is designed to enclose all of the operating, oscillating, and traversing mechanisms therein except for the interconnection to the louvers and control member(s).

It is a further object of this invention to provide a system having interchangeable parts so that many of the parts can be used for a variety of purposes within the system avoiding the need for numerous specialized parts.

It is a further object of this system to provide a support structure that while it might originally have vertical Venetian blinds suspended therefrom, it can be changed without significant alteration to support draperies of a variety of types without the need for replacing the track or carriers therein.

DETAILED DISCLOSURE

Figure 1:
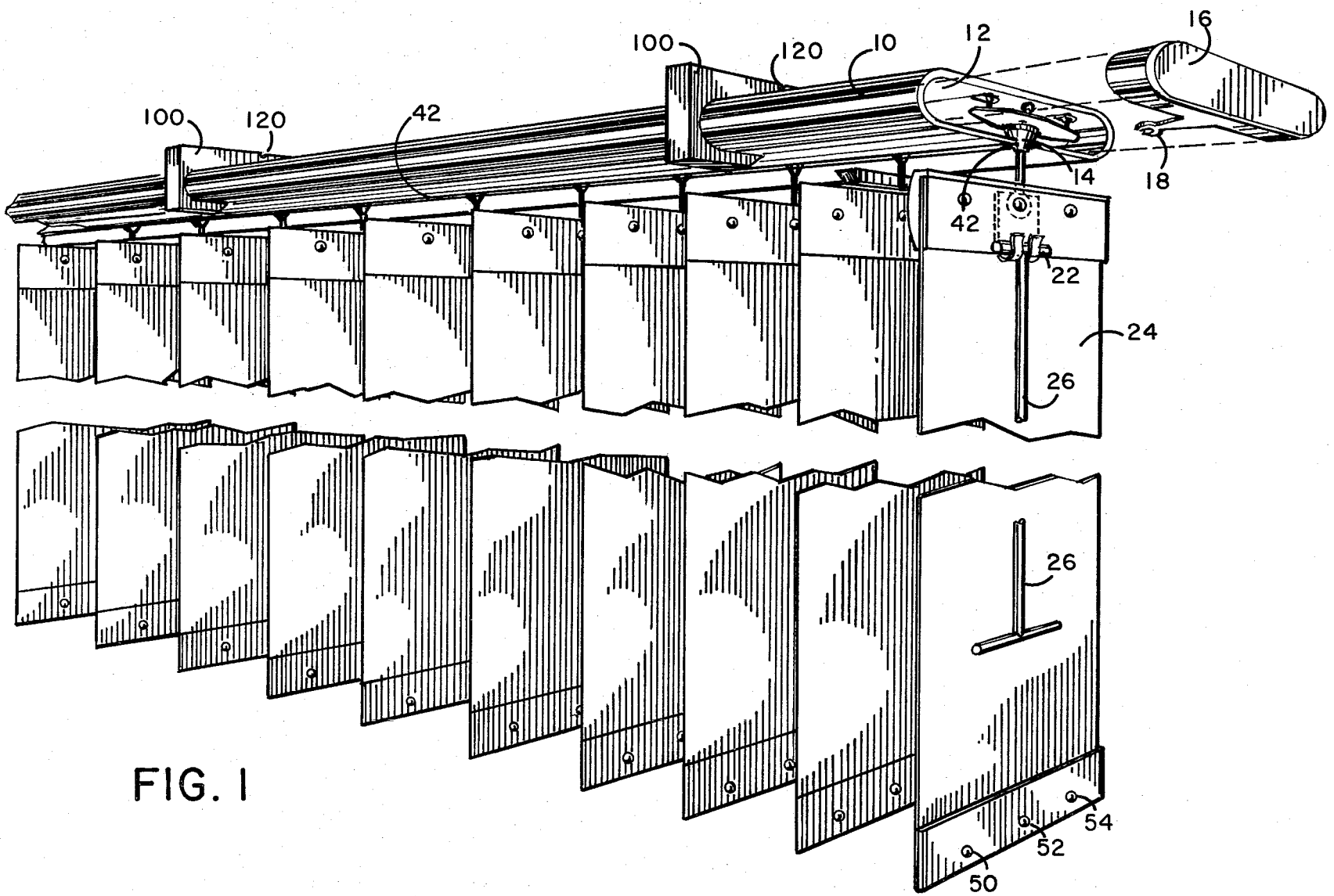
FIG. 1 is a perspective view of the track and carrier element system of the device of this invention having a plurality of louvers suspended therebetween.

FIG. 1 illustrates a perspective view of the system of this invention in use. Seen in this view is track 10 which is affixed by bracket means to a side of the area in which the vertical blinds are to be used. The use of the term "vertical blinds" herein also includes the use of the system of this device with other types of hanging draperies and the like. Track 10 is designed in cross-section as a C-shaped oval and in a preferred embodiment has a width substantially the same as the width of the louver to be utilized. Within track 10 is defined channel 12 extending the complete length of track 10. Defined in track 10 is an opening 42 which extends the complete length in a central position on the bottom of track 10. Within the track are positioned carrier members 14. There is usually one carrier member 14 for each louver to be supported by the apparatus of this invention. Each carrier member 14 consists of base 26 having a top and bottom. Extending from the top are a first, second, and third projection 28, 30 and 32, respectively, each of which has a protuberance at the tip thereof. Extending from the bottom of base 26 is shaft 34 having a truncated cone 36 positioned immediately adjacent to base 26. At the other terminating end of shaft 34 is ring member 38 having a ring aperture 40 defined therein. Base 26 is adapted to slide on the inside of track 10 within channel 12, and shaft 34 is adapted to pass through opening 42 so that its truncated cone portion 36 passes within the sides of opening 42. The angle of the sides of the truncated cone 36 causes only a small portion thereof to make slideable contact with the insides of opening 42, thereby decreasing frictional contact therebetween.

Figure 5:
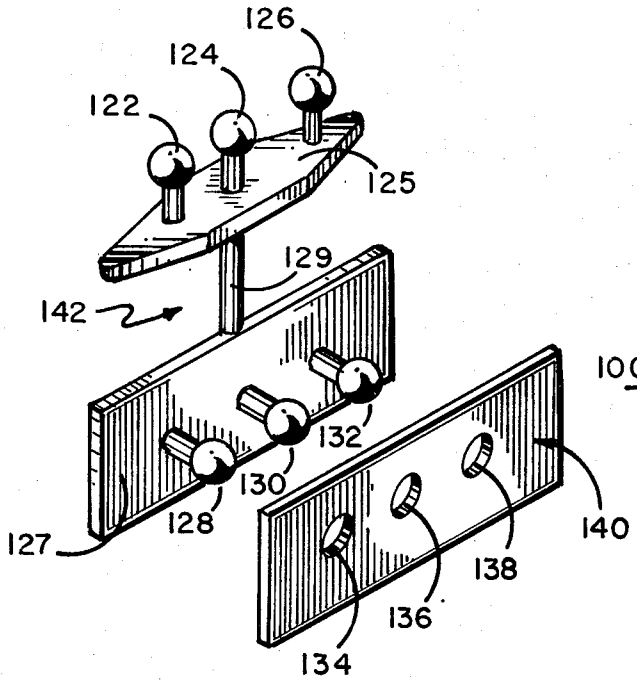
FIG. 5 illustrates a carrier of two-piece construction.

FIG. 5 illustrates an alternate embodiment of a carrier 142 of only two-piece construction. Seen is base 125, shaft 129, and back plate 127 all constructed in one piece with front plate 140 separated therefrom. In lower cost versions of this apparatus such a simplified carrier can be utilized, but it is unable to be utilized as support of as many different hanging elements as the preferred carrier discussed above.

A universal back plate 44 is utilized in this invention adapted to have more than one use. Universal back plate 44 is a substantially rectangular elongated planar member which can have a slightly curved rear surface 45 and a front surface 47 upon which are located three projection members 50, 52, and 54. At the top of universal back plate 44 is lip 46 which extends therefrom over said projection members, which lip has defined therein a groove 48 located above the central projection member 52. Also utilizable in other fashions as discussed below is universal front plate 68 being a substantially rectangular planar member having defined therein a series of three apertures 70, 72, and 74 which correspond in positioning and size to portions of the projections on universal back plate 44. Each projection member 50, 52 and 54 can have a section of wider diameter at its base and each projection can have a protuberance at its tip. In use one passes the central projection 52 of the universal back plate 44 through aperture 40 of ring 38 of carrier 14, and then one places a louver over the three projections on universal back plate 44 by either making apertures in the louvers such as apertures 56, 58, and 60 in corresponding positions to the projections on the universal back plate 44 or merely pressing, if the louver is fabric, the weave of the fabric around the projections. Then universal front plate 68 is positioned over those projections. Each of the protuberances of projections 50, 52, and 54 and the universal front plate 68 can be constructed of plastic or equivalent resilient material so that the protuberances will expand when on the other side of the universal front plate 68 to a size larger than apertures 70, 72 and 74 once the universal front plate is inserted thereover in order to retain the louver securely in position to carrier 14. Universal back plate 44 can also be utilized at the base of the louver to act as a weight or as a control member to prevent uncontrolled movement thereof. When used at the base, it can be turned upside down and the outer projections 50, 52 and 54 can have placed thereon washer members or weights. If positive control other than merely weight is desired, a bottom spacer member 82 having ring 84 with ring aperture 86 defined therein can be passed over central projection 52. Such bottom spacer can have affixed to ring 84 a shaft 88 which passes through groove 48 in lip 46 of universal back plate 44. At the bottom of shaft 88 is protuberance 90. One then can affix the louver or fabric in a similar manner as discussed above over the projections on universal back plate 44 and insert the front plate member 68 over the projections.

Figure 2:
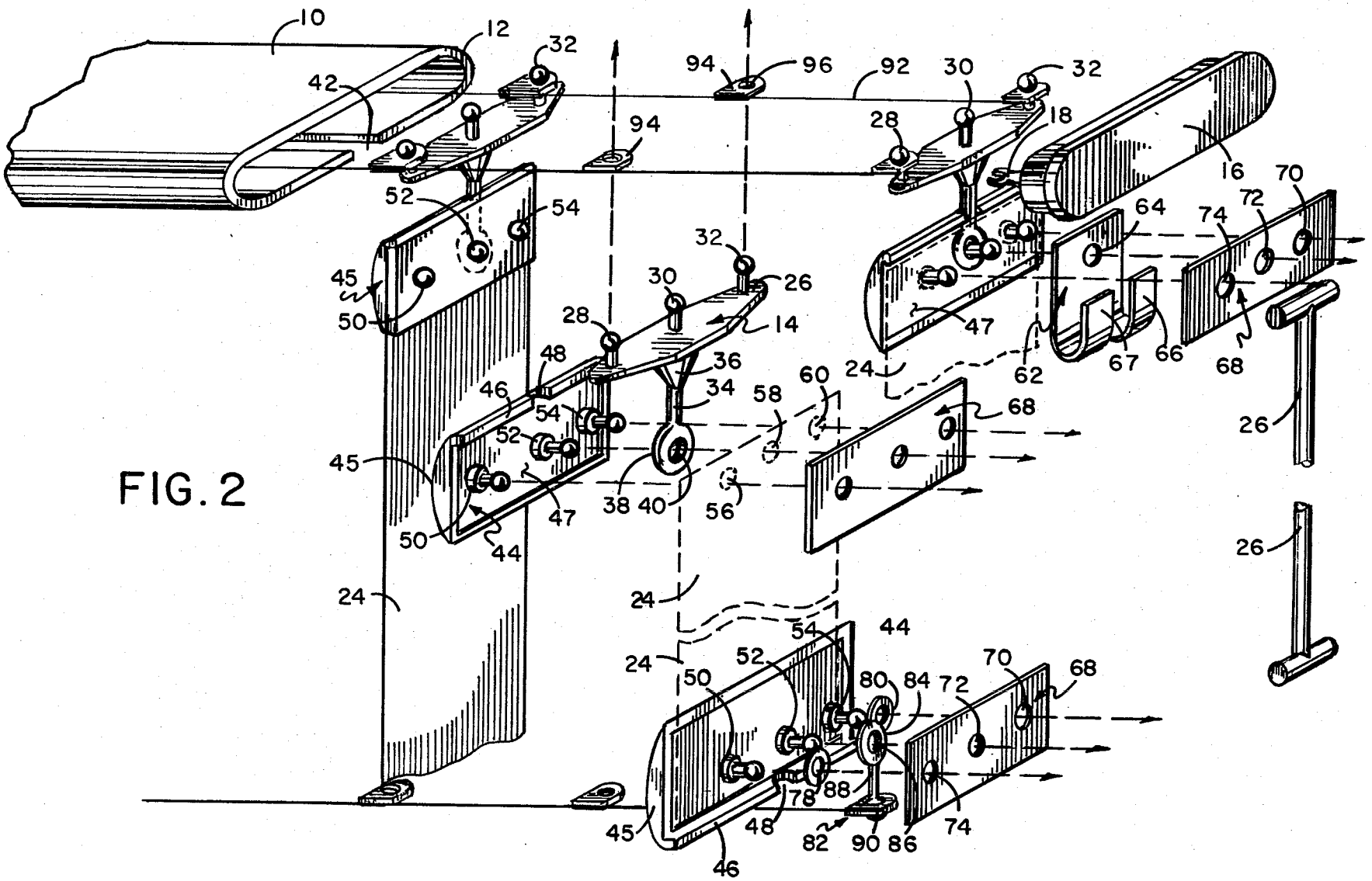
FIG. 2 is a perspective cutaway view of a track of this invention showing carrier elements and bottom plate.

At various places along the series of louvers, especially at the ends thereof, one may wish to place a control rod for the manual control of their transvers and rotational movement. After attaching the louver to the universal back plate 44, one may place a control rod clip 62 where one desires to position a control rod, which clip has an aperture 64 defined therein adapted to pass over over the central projection 52. Control rod clip 62 is retained in place when the universal front plate 68 is positioned on the projections. Extending below the universal front 68 is a section of control rod clip 62 which is curved and has a slot defined therein. It is desirable that control rod clip 62 be made of spring steel or equivalent material. A control rod 26 having a shaft is adapted to insert into the curved portion of control rod clip 62 with the shaft adapted to pass within the slot portion. One may also position a grasping member at the end of the shaft of control rod 26. The control rod can then control by manual activation and twisting the rotational and transverse movement the louvers as such movement of the louver affixed to the control rod will move all the interconnected louvers in the desired manner. To interconnect each carrier to one another, a cable member 92 is utilized. A series of similar cable members are depicted, one of which 92 is seen in FIG. 2. Such cable member consists of cable 92 which can be of nylon or equivalent material which has spaced thereon tab member 94 having an aperture 96 defined therein. The tabs 94 are adapted to snap onto projections 28, 30 and 32 of carrier 14 so that if one wished to interconnect all first projections 28 of a plurality of carriers, one would use a single cable member 92, attaching each of the tabs 94 in the series to each first projections 28 of each of the series of carriers 14. In a similar manner one would attach a second cable to each of the projections 32. The cables would extend through the track and their control functions will be described below. A third cable member illustrated in FIG. 2 can be used in one embodiment to affix to the shaft of the bottom spacer for the separation and control of the bottom of the louvers. It should be noted that all of the cable members have similar predetermined spacing between the tabs which correspond to the spacing desired between the louvers. Such spacing is usually equidistant between the tabs and depends upon the width of the louver being utilized. Therefore one can produce this cable on rolls in any length desired for use in the various positions described above within the system of this invention.

The second projections 30 on carrier 14 can be utilized when one wishes to hang ripple, accordian or sawtooth-effect draperies or equivalent multifold systems. In such use one affixes the drapery by its attachment means at its areas for suspension to the ring members 38 of the carriers 14 and utilizes a cable member having its tabs interconnect all of said second projections of the carriers. This apparatus supports and further prevents the draperies from flattening out as each carrier is held at a predetermined spacing from one another. Cables connecting its three projections in series are unnecessary. When hanging pinch-pleated draperies, the hooks at each pinch pleat can be passed through a ring aperture 40 and no cables are necessary to interconnect any carriers as this type of drapery is self-spacing.

Figure 4:
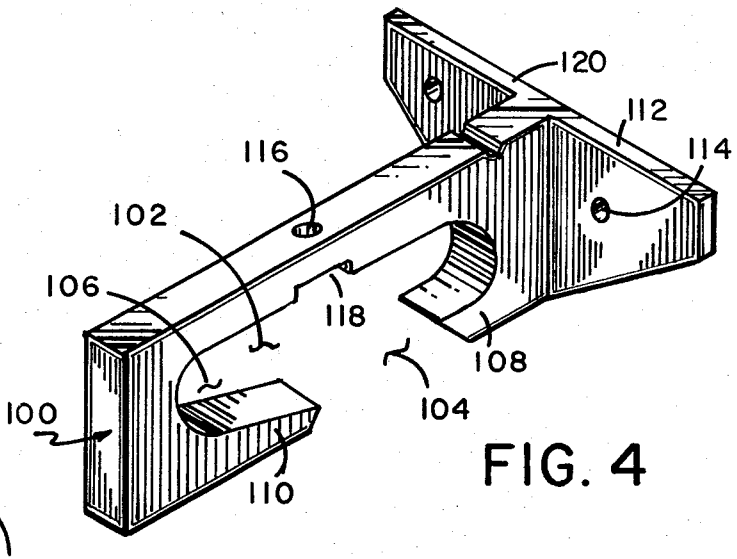
FIG. 4 illustrates a bracket utilized for support of the track.
Figure 3:
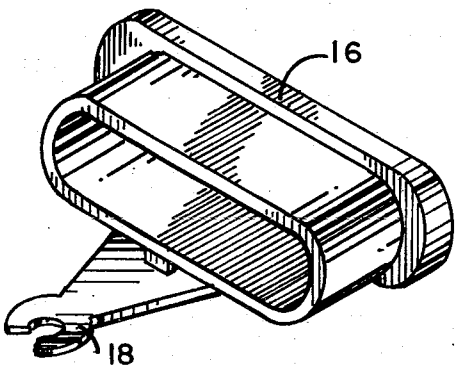
FIG. 3 illustrates an end cap with spacing stop member.

Once one has affixed the desired number of louvers to the carriers and has passed these into the tracks, one can insert an end cap 16 at the end of the track within the chamber adapted to fit securely within the channel being of a similar dimension to the inside of the channel and which has extending from the base thereof a carrier shaft catch member 18 which is positioned at a distance from end cap 16 to prevent the end of the carrier shaft from reaching the surface or wall which might prevent the complete rotation of the louver suspended therefrom. For example, if the louver were 3" in width, the carrier shaft catch member would be of a length to prevent the carrier from reaching the wall or surface any closer than $\frac{1}{2}$" to allow for its complete rotation. It also may be desirable for the louvers to overlap slightly when rotated to a closed position to prevent light from leaking therebetween. As needed one can utilize a series of support brackets 100 of the type illustrated in FIG. 4 for support of track 14. Support bracket 100 can have an aperture 102 defined therein with an open side 104 for the passage therethrough of the track. Track 14 is somewhat resilient being made of plastic or equivalent material in its preferred embodiment and is further compressible along opening 42. One portion of the track is inserted first in section 106 of the bracket 100 and when compressed, the track is pushed into position within aperture 102 by lip 108. It should be noted that the opposite lip 110 is longer than lip 108 so that more weight will rest upon lip 110 and therefore pull down that end of the bracket tending to close any gap between the track and the side of aperture 102 adjacent to lip 108 due to both downward and lateral pressure toward the wall surface. The backet can be affixed either to the wall by passing screws through apertures 114 in attached flange 112 or can be affixed to an upper surface by passing a screw or other equivalent fastening means upward through aperture 116. It is noted that below aperture 116 is channel 118 for receipt of the fastening means for preventing such means from protruding into aperture 102.

Valances can be utilized with the apparatus of this invention and slot 120 can be used for affixation of a support member thereof.

Although the present invention has been described with reference to particular embodiments, it will be apparent to those skilled in the art that variations and modifications can be substituted therefor without departing from the principles and spirit of the invention.

We claim:

1. An improved structure for the support and operation of hanging elements and the like such as vertical blinds having a plurality of louvers rotateably and slideably affixed to an elongated support member affixed to the top of the area where said hanging elements are hung wherein the improvement comprises:

said elongated support member being a track having a channel defined therein, said track being of a width substantially equal to the width of said hanging elements, said track further having an elongated opening defined in said channel extending its full length in a central part of the bottom thereof;

a plurality of carriers adapted for suspension of said hanging elements to said track, said carriers being further adapted to be slideably supported within said channel, each of said carriers having:

a horizontally disposed planar support member with top and bottom sides; first and second operation projections, each positioned on opposite ends of the top of said support member, said first and second projections each having a protuberance at the ends thereof;

a vertically disposed shaft affixed to the bottom of said support member in a central position, said shaft having a wider portion at its top forming a truncated cone at its junction with said support member, said wider portion adapted to travel in said elongated opening of said channel so that only a small portion of said vertical shaft contacts the sides of said opening;

a ring member affixed at the bottom of said vertical shaft;

a first link means for interconnecting each of said first operation projections on said carriers to first operation projections on another of said carriers at equidistant predetermined spacings;

a second link means for interconnecting each of said second operation projections on said carriers to second operation projections on another of said carriers at equidistant predetermined spacings;

said first and second link means being contained within said channel and each including spacer cables with tab means spaced equidistant from one another thereon at the desired position of each carrier, said tab means having an aperture defined therein adapted to pass over the protuberance at the end of each first and second operation projections and be retained on such projections;

a substantially rectangular planar first plate member having a first lateral retention projection, second central retention projection, and third lateral retention projections disposed along one face protruding therefrom, the second central projection being inserted through the aperture of said ring member;

a lip positioned along the top of said first plate member having a groove defined therein located substantially above said central projection, said groove adapted to receive said shaft;

said hanging element having three apertures defined at its top into which are inserted said first plate member's first lateral retention projection, second central retention projection and said third lateral retention projection;

a substantially rectangular planar second plate member having three apertures defined therein into which are inserted said first lateral projection, second central projection and third lateral projection of said first plate member after said projections have engaged the top of the hanging elements, said first plate and said second plate adapted to hold said hanging element securely therebetween;

at least one control rod clip affixed between one pair of said first and second plates, said control rod clip having an aperture defined therein for receipt of said first plate's second central retention projection and further including a curved portion adapted to extend out from the bottom between said first and second plates, said extending portion having a slot defined therein; and at least one control rod having a T-shaped end the horizontal top of which is held in the curved portion of said control rod clip and having its vertical shaft member held in said clip's slot wherein rotation of said control rod rotates the carrier to which said control rod clip is attached and moves said first and second link means to cause similar rotation of the other carriers, and the movement of the control rod in a direction horizontal to said track causes like horizontal movement of said carriers within said track.

2. The apparatus of claim 1 further including a third operation projection in a central location on the top of said carrier support member.

3. The apparatus of claim 1 further including means to hold the bottom of said hanging elements from uncontrolled movement.

4. The apparatus of claim 3 wherein said means to hold the bottom of said hanging elements from uncontrolled movement comprises:

an additional first plate member utilized in an inverted position with its lips on the bottom;

a pair of washer members positioned upon said first retention lateral projection and said third retention lateral projection of said additional first plate member;

a bottom spacer including a ring member with an aperture defined therein positioned on said second central projection;

a shaft member affixed to said ring member adapted to pass through the groove in said lip of said additional first plate, said shaft having a protuberance at its end opposite its attachment to said ring; and said hanging element having defined at its bottom three apertures through each of which are inserted respectively said first retention lateral projection, said second central retention projection and said third lateral retention projection; an additional second plate member inserted onto said first, second, and third retention projections adapted to hold said hanging element securely therebetween; and a third link means for interconnecting the bottom of said spacer shafts at equidistant predetermined spacing.

5. The apparatus of claims 1, 3 or 4 further including:

at least one end cap member adapted to be received at the end of said track within said channel; and shaft catch means affixed to said end cap member adapted to extend therefrom to stop further lateral movement of a carrier toward an end of said track.

6. The apparatus of claim 5 further including bracket means for the support of said track.

7. The apparatus of claim 6 wherein said bracket means further include a support bracket having an aperture defined therein substantially the shape of a cross-section of said track, said support bracket aperture having an opened side defined in the bottom thereof adapted for the insertion of said track therethrough, the sides of said open side forming a first and second lip, said first lip adapted to extend further than said second lip; flange means affixed to the same side of said bracket as said second lip; said flange means including means for receipt of fastening means to hold said bracket to a surface; and an aperture defined within said bracket at the top of said bracket aperture above said opening for receipt of additional fastening means.

* * * * *